US009937982B2

(12) United States Patent
Paquet

(10) Patent No.: US 9,937,982 B2
(45) Date of Patent: Apr. 10, 2018

(54) SYSTEM FOR TRANSFERRING FLUID BETWEEN A FACILITY AND A VESSEL

(71) Applicant: Technip France, Courbevoie (FR)

(72) Inventor: Stephane Paquet, Septeuil (FR)

(73) Assignee: TECHNIP FRANCE, Courbevoie (FR)

( * ) Notice: Subject to any disclaimer, the term of this patent is extended or adjusted under 35 U.S.C. 154(b) by 82 days.

(21) Appl. No.: 14/914,446

(22) PCT Filed: Aug. 28, 2014

(86) PCT No.: PCT/FR2014/052141
§ 371 (c)(1),
(2) Date: Mar. 30, 2016

(87) PCT Pub. No.: WO2015/028754
PCT Pub. Date: Mar. 5, 2015

(65) Prior Publication Data

US 2016/0221646 A1 Aug. 4, 2016

(30) Foreign Application Priority Data

Aug. 30, 2013 (FR) ..... 13 58342

(51) Int. Cl.
*B63B 27/24* (2006.01)
*B63B 27/25* (2006.01)
*B63B 27/34* (2006.01)

(52) U.S. Cl.
CPC ..... *B63B 27/24* (2013.01); *B63B 27/25* (2013.01); *B63B 27/34* (2013.01)

(58) Field of Classification Search
CPC ..... B63B 27/27; B63B 27/25; B63B 27/34; F17C 5/06; F17C 2260/61; F17C 2260/56; F17C 2260/42; F17C 2260/25
USPC ..... 141/387
See application file for complete search history.

(56) References Cited

U.S. PATENT DOCUMENTS 3,984,059 A * 10/1976 Davies ..... B63B 27/24 138/114
4,418,718 A * 12/1983 Fusy ..... B63B 27/24 137/615
6,659,703 B1 12/2003 Kirkley
9,346,521 B2 * 5/2016 Lachaud ..... B63B 23/40
2009/0165874 A1 * 7/2009 Pollack ..... B63B 27/24 137/615
2009/0205343 A1 * 8/2009 Dupont ..... B63B 27/24 62/50.7
2010/0313977 A1 12/2010 Sylard

* cited by examiner

*Primary Examiner* — Timothy L Maust
*Assistant Examiner* — Andrew Schmid
(74) *Attorney, Agent, or Firm* — Leydig Voit & Mayer

(57) ABSTRACT

A system for transferring a fluid between a fixed or floating facility for producing or storing the fluid, and a vessel. The system includes at least one hinged arm arrangement that includes an inner arm hinged at one end to a support structure, so as to pivot in a vertical plane, and an outer arm hinged on the outer end of the inner arm. The hinged arm arrangement further includes a rotary seal having an axis extending in a longitudinal direction of the hinged arm. The rotary seal is disposed at the hinge linking the inner arm to the support structure.

8 Claims, 6 Drawing Sheets

Fig.3
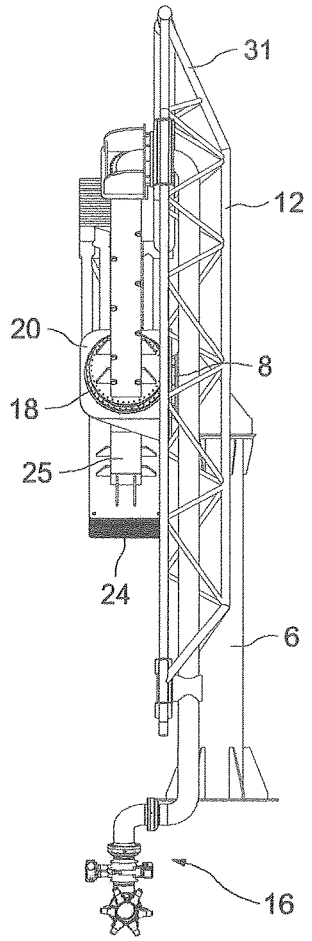
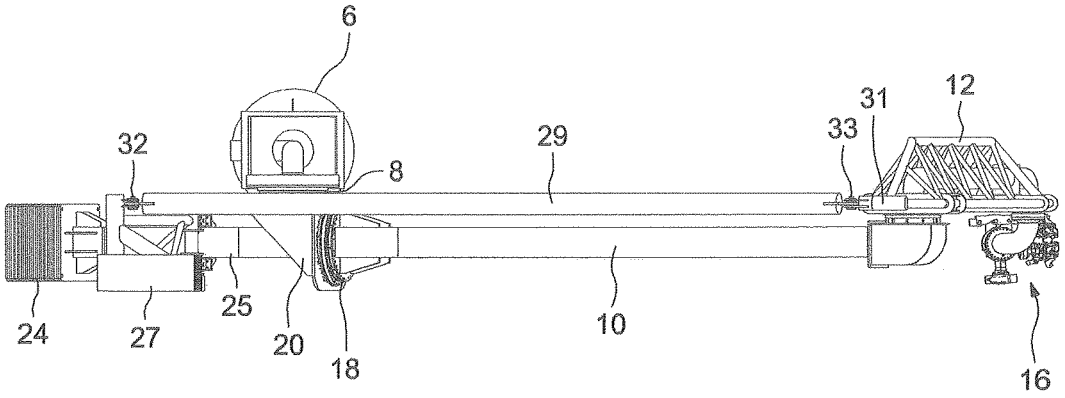
Fig.4

Fig. 7
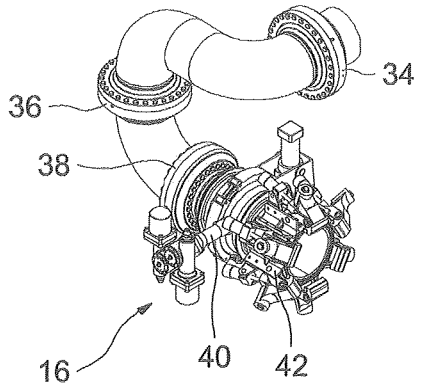
Fig. 8
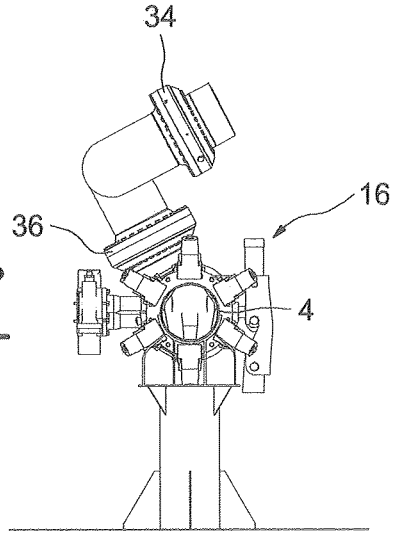
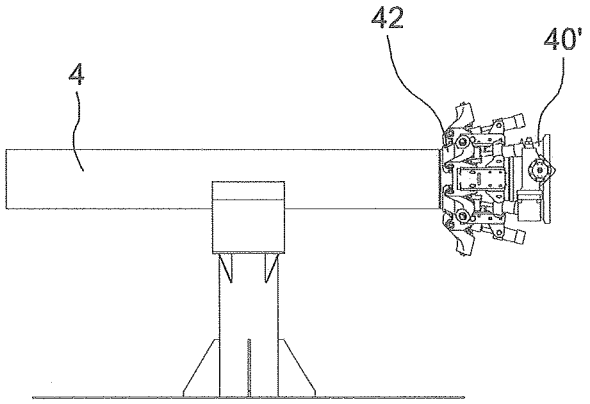
Fig. 9

SYSTEM FOR TRANSFERRING FLUID BETWEEN A FACILITY AND A VESSEL

FIELD OF THE INVENTION

The invention relates to a fluid system between a fixed or floating facility for producing or storing fluid and a vessel, such as a liquid natural gas carrier, of the type comprising at least one arrangement of articulated arms that includes an inner arm articulated at one end by a joint with a horizontal axis to a support structure so as to pivot in a vertical plane, and an outer arm articulated at one end to the outer end the inner arm, by a rotary joint, the axis of which is oriented horizontally when this arm extends vertically, and bearing, at its free end, a device for connecting/disconnecting to or from a vessel manifold, the articulated arm arrangement further including a rotary joint whereof the axis extends in the longitudinal direction of that arm, and being provided with counterweights positioned on the inner arm at its articulation to the support structure.

BACKGROUND

A transfer system of this type is already known from French patent application FR 2,903,653. In the system described in this document, the rotary joint whereof the axis extends in the longitudinal direction of the arm is positioned at the articulation to the outer arm, which has the drawback that a relatively significant weight is placed at the free end of the inner arm. Furthermore, a heavy and cumbersome part of the system, comprising at least one rotary joint, is transferred to the liquid natural gas carrier or is mounted on the manifold.

Another major drawback lies in the fact that the outer arm is not balanced.

Added to these drawbacks is also that due to the architecture of the arm device, the emergency disconnect device is vertical, such that, in case of emergency disconnect, the part of this device abandoned on the liquid natural gas carrier may tilt.

SUMMARY OF THE INVENTION

The invention aims to offset these drawbacks.

To achieve this aim, the transfer system according to the invention is characterized in that the rotary joint whereof the axis extends in the longitudinal direction of the inner arm is positioned at the articulation of the inner arm to the support structure.

According to another feature of the invention, the system is characterized in that it comprises balancing means for the outer arm.

According to still another feature of the invention, the system is characterized in that the balancing means of the outer arm comprise a counterweight that is mounted on the support structure-side end of the inner arm, so as to rotate with that arm when the latter rotates around its longitudinal axis, and is connected to the outer arm by connecting means.

According to still another feature of the invention, the system is characterized in that the balancing counterweight for the outer arm is arranged at an angle of a connecting mechanism to the inner and outer arms, in the form of a deformable parallelogram and secured in rotation with the inner arm.

According to still another feature of the invention, the system is characterized in that the counterweight is positioned at one end of a rod device whereof the other end is articulated only to the inner arm, and in that the counterweight is articulated at one end of a connecting rod whereof the other end is articulated to an axial extension of the outer arm, on the side of the articulation to the inner arm.

According to still another feature of the invention, the system is characterized in that the rod device is articulated to a provided axial extension of the inner arm, on the support side, and carries a balancing counterweight for the inner arm.

According to still another feature of the invention, the system is characterized in that the connecting/disconnecting device to/from a vessel manifold comprises three rotary joints whereof the rotary axes are perpendicular to one another, an emergency disconnect mechanism and removable connecting means to the manifold, in that the emergency disconnect mechanism is in particular positioned next to the connecting means while being axially aligned with those means and the manifold such that, in an emergency disconnect case, only part of the emergency disconnect mechanism and the connecting means remain connected to the manifold.

According to still another feature of the invention, the system is characterized in that the support structure is a support mast.

According to still another feature of the invention, the system is characterized in that it comprises a plurality of arrangements of articulated arms each mounted on the support structure, next to one another, such that they can be connected to vessel manifolds without bothering one another.

BRIEF DESCRIPTION OF DRAWING FIGURES

The invention will be better understood, and other aims, features, details and advantages thereof will appear more clearly, during the following explanatory description done in reference to the appended diagrammatic drawings, provided solely as an example illustrating one embodiment of the invention and in which:

FIG. 3 is a front view of the system according to FIG. 1 of the invention;

FIG. 4 is a top view of the system according to FIG. 1;

FIG. 7 is a perspective view of a connection/disconnection device according to the invention;

FIG. 8 is a front view of the connection/disconnection system, in its position connected to the manifold, before an emergency disconnect, and FIG. 9 is a side view of the manifold after an emergency disconnect.

DETAILED DESCRIPTION

Figure 1:
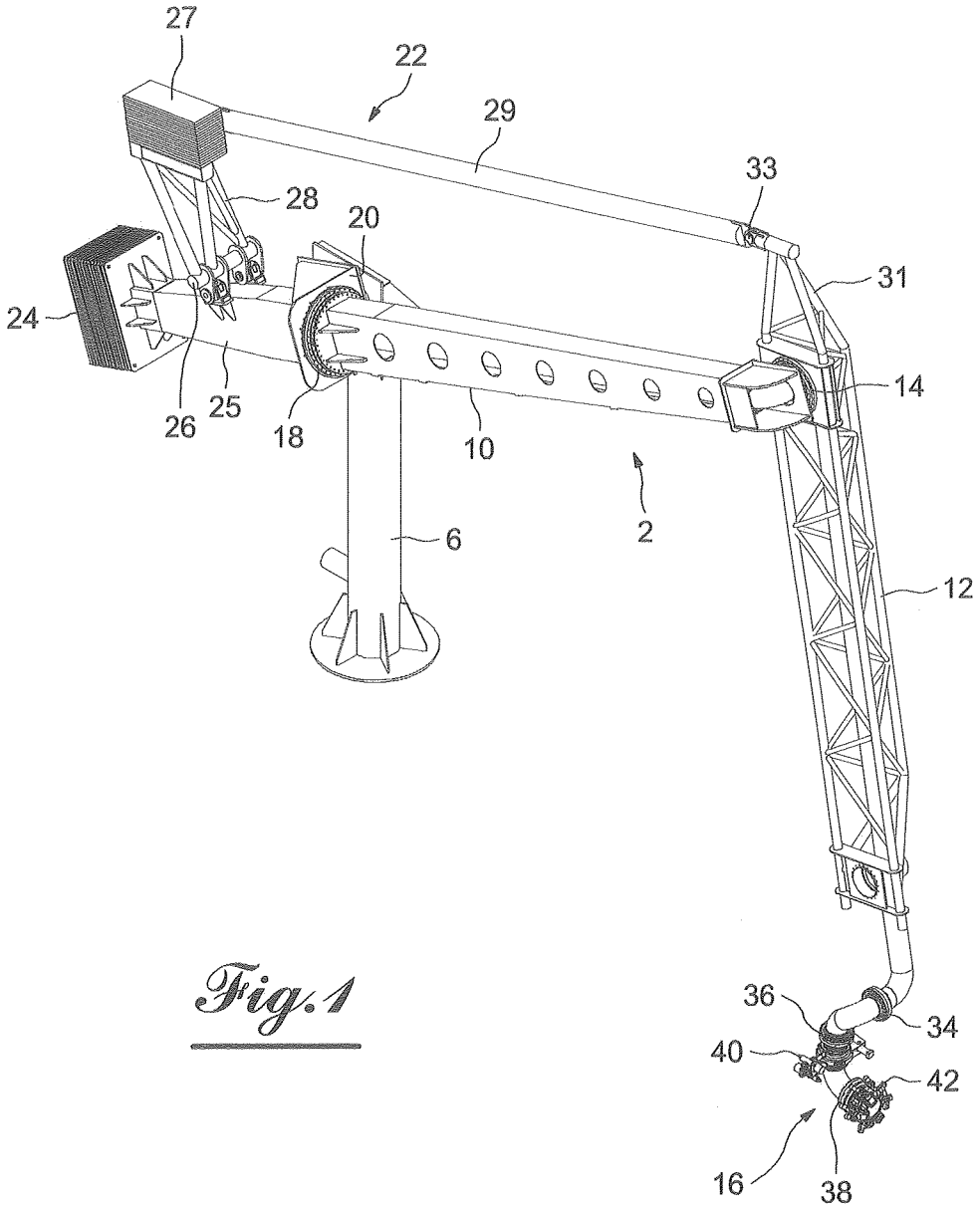
FIG. 1 is a perspective view of a system for transferring a fluid according to the invention, in a deployed position.
Figure 2:
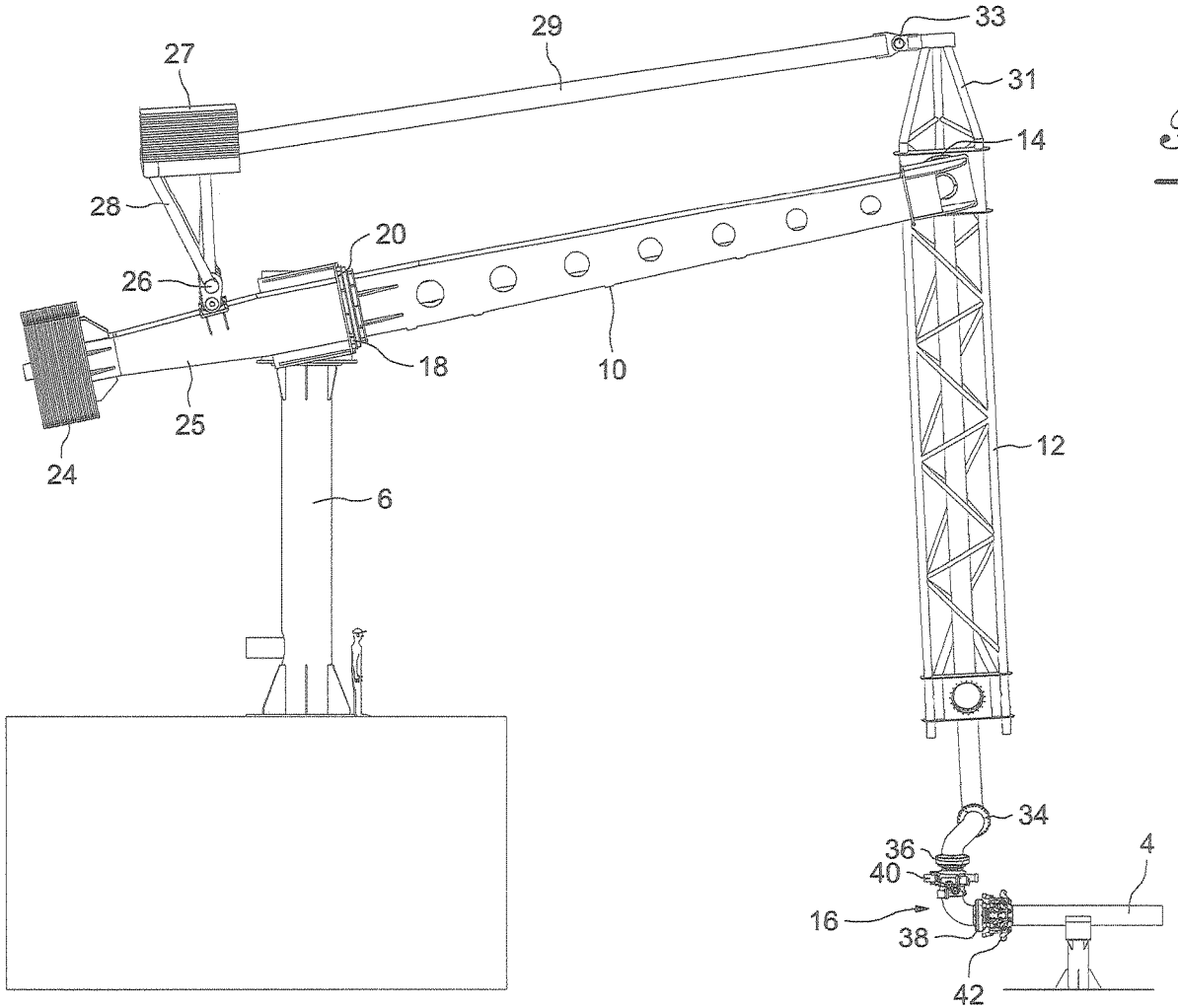
FIG. 2 is a side view of the system of FIG. 1, connected to a vessel manifold.

As emerges in particular from FIGS. 1 to 4, a system for transferring a fluid, in particular liquid natural gas (LNG), comprises at least one articulated arm arrangement 2 designed to be connected to a manifold 4, according to FIG. 2, of a vessel such as a liquid natural gas carrier (not shown), the articulated arm arrangement being part of a fixed or floating facility for producing or storing fluid.

The articulated arm device 2 comprises a support structure, made in the illustrated example in the form of a vertical support mast 6, at the top of which is mounted, pivoting in a vertical plane, by means of the first rotary joint at the horizontal axis 8, an inner arm 10 that bears, at its free end, an outer arm 12 that is articulated to the arm 10 by a second rotary joint 14, the axis of which is oriented horizontally when this arm extends vertically. Mounted at the free end of the outer arm 12 is a connection/disconnection device 16 with three rotary joints, and which is designed to be connected to the manifold 4 of a vessel.

The articulated arm arrangement 2 comprises a third rotary joint 18 whereof the axis extends in the longitudinal direction of the inner arm 10 and that is positioned at the articulation of this arm to the support mast 6. This joint 18 allows the inner arm 10 to rotate around its longitudinal axis and therefore allows the connection/disconnection device 16 to move perpendicular to the vertical pivoting plane of the inner arm 10.

More specifically, one can see that the inner arm 10 is supported via the rotary joint 18, by a part 20 that is mounted pivoting on a lateral face of the top of the support mast 6 so as to establish the rotary joint with a horizontal axis 8. The joint 18 is for example made by a ball bearing.

The articulated arm arrangement 2 is balanced by a counterweight device 22 comprising a first counterweight 24 that is positioned at the end of the extension 25 of the arm 10 on the side of the articulation of the mast 6. A second counterweight 27 is mounted on the extension 25 using a rod device 28 articulated at 26 to the extension 25 and is situated in the idle state without rotation of the arm 10 in the vertical pivoting plane of that arm 10. In this position, the pivot axis 26 of the rod device extends perpendicular to this vertical plane.

The counterweight 27 is further connected by a connecting rod 29 to the end of an axial extension 31 of the outer arm 12, on the side of the articulation of this outer arm 12 to the inner arm 10 by means of the rotary joint 14. The ends of the connecting rod 29 are respectively articulated to the counterweight 27 and the end of the extension 31, at 32 and 33, such that the counterweight 27 is positioned at a corner of a deformable parallelogram, formed by the inner arm 10 and the connecting rod 29, on the one hand, and the rod device 28 and the extension 31 on the other hand, with pivot axes 26, 32, 33 and the joint 14.

This parallelogram is secured to the inner arm 10 so as to pivot with this arm when the latter rotates around its longitudinal axis. The counterweight 27 thus forms a balancing means specific to the outer arm 12, while the counterweight 24 balances the inner arm 10.

The connection/disconnection device 16 to/from the manifold 4 of a vessel comprises three rotary joints 34, 36, 38 in order from the end of the arm 12, the rotary axes of which are perpendicular to one another, an emergency disconnect mechanism 40 positioned between the joints 36 and 38 and the removable connecting means 42 to the manifold 4.

FIGS. 7 to 9 show an improved embodiment of the connection/disconnection device 16. This embodiment of the connection/disconnection device 16 is designed to be connected to a horizontal manifold 4 without a part remaining connected to the manifold that may pivot around the axis of the manifold after an emergency disconnect.

To that end, the emergency disconnect mechanism 40 is positioned between the last rotary joint 38 and the connecting means 42. The emergency disconnect mechanism 40 and the connector 42 are axially aligned relative to one another and the manifold. Thus, after an emergency disconnect, only half 40' of the emergency disconnect mechanism 40 and the connector 42 remain connected to the manifold. The invention therefore makes it possible to avoid tilting of the abandoned part, remaining on the manifold.

Advantageously, the emergency disconnect device 40 is a double butterfly valve system, to make it possible to reduce the mass and bulk, on the one hand, as well as the residual volume of liquid natural gas between the two valves. Such a system is described in European patent EP 1,405,003.

Figure 5:
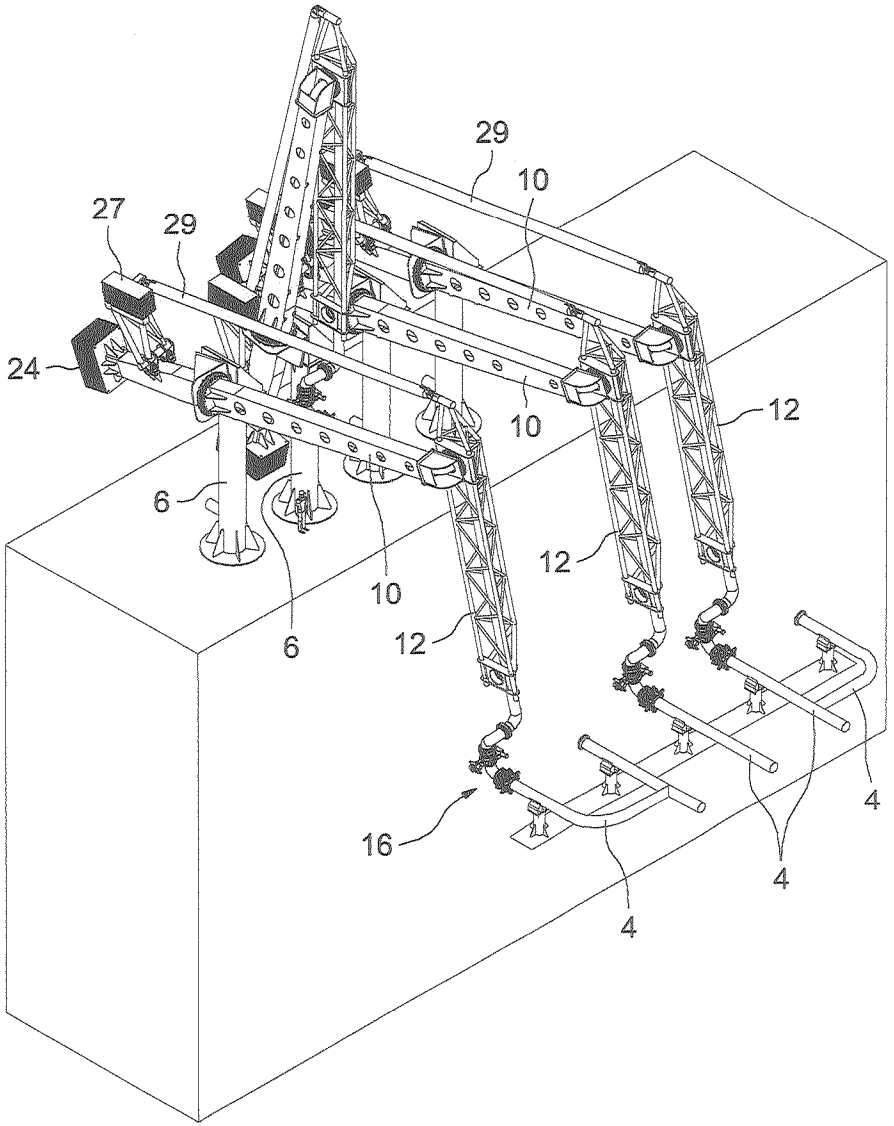
FIG. 5 is a perspective view of a system including a plurality of articulated arm arrangements according to the invention connected to several manifolds of a vessel.
Figure 6:
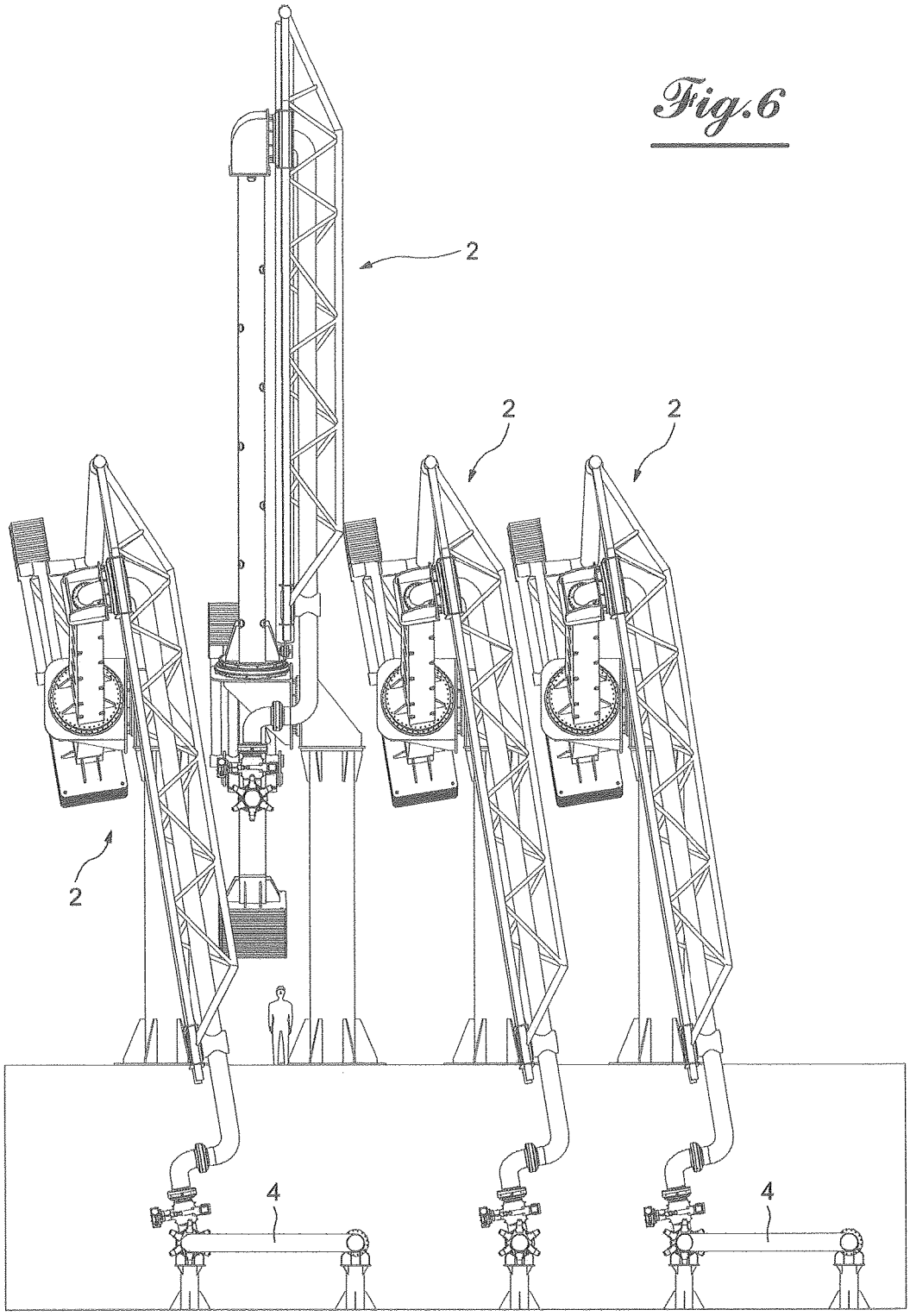
FIG. 6 is a front view of the system according to FIG. 5.

Previously has been described a transfer system according to the invention that only includes one articulated arm arrangement 2. FIGS. 5 and 6 show a system according to the invention, which comprises a plurality of articulated arm arrangements, in the illustrated example, three of which are shown in the state connected to a manifold 4 while the fourth is in the folded idle position. The figures illustrate one advantage of the invention, which lies in the fact that the connection/disconnection devices 16 of the adjacent articulated arm arrangements 2 do not risk bothering one another by coming into contact with one another and the arms do not sweep the deck.

It should be noted that the invention is designed to transfer fluid, including liquid natural gas (LNG).

The system according to the invention has multiple advantages. It has been designed so that the forces exerted on a manifold of a vessel, such as a liquid natural gas carrier, are very low. Because wind in the longitudinal direction of the vessels is a major factor creating forces by the articulated arm arrangement on the manifold, the invention makes it possible to reduce these forces substantially by causing the inner arm to pivot only in a single vertical plane. Thus, the end of the inner arm that bears the outer arm becomes, for the latter, a "fixed" bearing point in the longitudinal direction of the vessels. Only the effects of the wind transmitted to the lower end of the outer arm have an impact on the forces at the manifold, which makes it possible to significantly reduce the forces at the manifold.

The balancing not only of the inner arm, but also the outer arm makes it possible to minimize the forces imposed by the arms on the manifolds of the liquid natural gas carriers. The mass mobilized by the movements of the liquid natural gas carriers is minimal because the counterweights are positioned at the support mast 6.

The invention makes it possible to increase the structural stiffness of the arms, which makes it possible to significantly reduce the effect of the vibrations and avoid dynamic amplification phenomena of the forces.

It should be noted that the connection of an articulated arm arrangement according to the invention can be done by maneuvering the arrangement by an operator assisted by a system for compensating movements of the vessels, which is known in itself. In a first step, the operator maneuvers the arm and positions it in an intermediate position. Then, in the following step, the movement compensating system is started up such that the end follows the movements of the manifold. Lastly, in the third step, the movement compensating system is still in action and the operator steers the advance of the end of the outer arm toward the manifold and performs the connection. Of course, the connection could also be done completely automatically. To that end, the outer arm leaves its stowed position or an intermediate position and connects automatically to the manifold with no direct intervention by the operator. These connecting maneuvers are simplified by the fact that the mass of the moving parts is minimized.

The emergency disconnect device being horizontal and situated directly next to the quick connection/disconnection connector, in case of emergency disconnect, the part abandoned on the manifold is reduced, and cannot tilt.

Of course, multiple modifications can be made to the invention as described and illustrated in the figures, without going beyond the scope of the invention. Thus, regarding the articulations 8, 18 and 14, the production of their rotary joints with separation of the mechanical and fluid passage functions is not mandatory, and these joints can be implemented in any other known appropriate manner.

The invention claimed is:

1. A system for transferring a fluid between a fixed or floating facility for producing or storing the fluid, and a vessel, the system comprising:

an arrangement of articulated aims that includes a support, a first rotary joint mounted on the support and rotating about a first axis of rotation that is horizontal, an inner aim having first and second ends, and a longitudinal axis extending between the first and second ends, wherein the inner arm is mounted to the first rotary joint at a location on the inner arm that is between the first and second ends, so the inner arm is articulated on the support and pivots in a vertical plane upon rotation of the first rotary joint about the first axis of rotation that is horizontal, a second rotary joint mounted at the second end of the inner arm and having a second axis of rotation, an outer arm having inner and outer ends and mounted to the second rotary joint at the inner end of the outer arm and thereby articulated to the second end of the inner arm, wherein the second axis of rotation is horizontal when the outer arm extends vertically, a device connected to the outer end of the outer arm for connecting the outer arm to and disconnecting the outer arm from a vessel manifold, a third rotary joint mounted on the support and having a third axis of rotation, wherein the inner arm is mounted to the third rotary joint, and the third axis of rotation is aligned with the longitudinal axis of the inner arm, and a first counterweight mounted at the first end of the inner arm.

2. The system according to claim 1, comprising balancing means for balancing the outer arm.

3. The system according to claim 2, wherein the balancing means comprises a second counterweight pivotally mounted to the inner arm and rotating with the inner arm when the inner arm rotates around the third axis of rotation that is aligned with the longitudinal axis of the inner arm.

4. The system according to claim 3, wherein the balancing means further comprises:

a rod device having a first end pivotally connected to the second counterweight and a second end pivotally connected to the inner arm proximate the second end of the inner arm;

a rod having first and second ends, wherein the first end of the rod is pivotally connected to the second counterweight;

an extension of the outer arm extending from the inner end of the outer arm, away from the outer end of the outer arm;

connecting means pivotally connected to the second end of the rod and pivotally connected to the extension, whereby the rod device, the rod, the connecting means, and the inner arm form a parallelogram shape having internal angles that change as the outer arm rotates relative to the inner arm at the second rotary joint.

5. The system according to claim 4, wherein the rod device is pivotally connected to the inner arm between the second end of the inner arm and the first rotary joint.

6. The system according to claim 1, wherein the device for connecting the outer arm to and disconnecting the outer arm from a vessel manifold comprises three rotary joints having rotary axes that are mutually perpendicular to each other, an emergency disconnect mechanism, and removable connecting means for disconnection from the vessel manifold, wherein the emergency disconnect mechanism is positioned next to the removable connecting means and is axially aligned with the removable connecting means and the vessel manifold, such that, in an emergency disconnection, only part of the emergency disconnect mechanism and the removable connecting means remain connected to the manifold.

7. The system according to claim 1, wherein the support is a support mast.

8. The system according to claim 1, further comprising a plurality of the arrangements of articulated aims, wherein each arrangement of articulated arms includes a respective support, and the respective supports are located sequentially, with each support next to another support, such that the arrangements of articulated arms can be connected to respective vessel manifolds without interfering with one another.

* * * * *